US007607822B2

(12) United States Patent
Cabezas Jurin et al.

(10) Patent No.: US 7,607,822 B2
(45) Date of Patent: Oct. 27, 2009

(54) ESCAPEMENT INCLUDING TWO ESCAPE WHEELS

(75) Inventors: Andrés Cabezas Jurin, Yverdon-les-Baines (CH); Thierry Conus, Lengnau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 12/105,644

(22) Filed: Apr. 18, 2008

(65) Prior Publication Data

US 2008/0259737 A1 Oct. 23, 2008

(30) Foreign Application Priority Data

Apr. 18, 2007 (EP) ..... 07106377

(51) Int. Cl.
*G04B 15/00* (2006.01)

(52) U.S. Cl. ..... 368/127; 368/131

(58) Field of Classification Search ..... 368/124, 368/125, 127–131, 168–169; 74/1.5
See application file for complete search history.

(56) References Cited

U.S. PATENT DOCUMENTS

| | | | | |
|---|---|---|---|---|
| 0,594,446 | A | 11/1897 | Voigt | |
| 1,037,342 | A | 9/1912 | Shortill | |
| 1,091,261 | A | 3/1914 | Walker | |
| 2,531,273 | A | 11/1950 | Jaccard | |
| 6,301,981 | B1 * | 10/2001 | Oechslin | 74/1.5 |
| 6,708,576 | B2 * | 3/2004 | Oechslin | 74/1.5 |
| 6,802,645 | B2 * | 10/2004 | Ludwig | 368/127 |
| 7,097,350 | B1 | 8/2006 | Conus | |
| 7,192,180 | B2 | 3/2007 | Hayek et al. | |
| 7,366,058 | B2 * | 4/2008 | Marki et al. | 368/220 |
| 2005/0128880 | A1 | 6/2005 | Hayek et al. | |
| 2006/0221774 | A1 | 10/2006 | Conus et al. | |

FOREIGN PATENT DOCUMENTS

| | | |
|---|---|---|
| CH | 4698 | 3/1892 |
| CH | 373703 | 1/1964 |
| EP | 0 018 796 | 11/1980 |
| EP | 1 045 297 | 10/2000 |
| EP | 1 367 462 A1 | 12/2003 |
| EP | 1 708 047 | 10/2006 |

OTHER PUBLICATIONS

European Search Report issued in corresponding application No. EP 07 10 6377 completed Feb. 18, 2008.
Daniels, George, "La Montre: Principles et Methodes de Fabrication," 1993, pp. 236-239.

(Continued)

*Primary Examiner*—Vit W Miska
(74) *Attorney, Agent, or Firm*—Griffin & Szipl, P.C.

(57) ABSTRACT

The escapement includes first (1) and second (2) escape wheels each driven by independent gear trains and barrels. The system includes a brake lever (8) cooperating with an impulse pin (7) of the roller (4) and with the escape wheels via locking pallet stones (12, 13). The roller carries pallet stones (10, 11) for receiving impulses from the escape wheels. When the wheels are locked, the brake lever occupies a centred position relative to said wheels. Means (16, 30, 31) for re-engaging the locking pallet stones in the toothing of the wheels are provided to ensure proper operation of the system.

7 Claims, 5 Drawing Sheets

OTHER PUBLICATIONS

Daniels, George, "La Montre: Principles et Methodes de Fabrication," 1993, pp. 236-248.
Chamberlain, P. M., "It's About Time—The Lever Escapement," 1978, pp. 77-81.
Office Action issued in related U.S. Appl. No. 12/105,492, mailed Sep. 17, 2008.
Office Action issued in co-pending related U.S. Appl. No. 12/105,447, dated Jun. 22, 2009.

* cited by examiner

ESCAPEMENT INCLUDING TWO ESCAPE WHEELS

This application claims priority from European Patent Application No. 07106377.0, filed Apr. 18, 2007, the entire disclosure of which is incorporated herein by reference.

FIELD OF THE INVENTION

The invention relates to a detent escapement for a timepiece, including first and second escape wheels each driven by independent gear trains and barrels and a balance on the pivot of which there is secured a roller, the axis of rotation of said pivot being substantially equidistant from the axes of rotation of the first and second wheels, said roller carrying an impulse pin arranged for cooperating with a brake lever articulated on a pivot, and carrying first and second impulse pallet stones, arranged for cooperating respectively with the first and second wheels.

BACKGROUND OF THE INVENTION

An escapement broadly answering the description that has just been given was disclosed in the work entitled "La Montre: principes et méthodes de fabrication", by George Daniels, Scriptar Editions S.A., La Conversion, Lausanne 1993. This escapement is explained at pages 236 to 239 of said work and a drawing is reproduced in FIG. 1 of this document to illustrate this prior art.

As FIG. 1 shows, the Daniels escapement includes a brake lever 40 located between two escape wheels A and B. This brake lever 40 is articulated on a pivot 41 and is controlled by an impulse pin 42 of roller 43. Roller 43 is secured to a balance that is not shown and the pivot 44 of the roller is substantially equidistant from the axes of rotation of wheels A and B. Roller 43 carries two pallet stones 45 and 46 arranged for receiving impulses respectively from wheel A then wheel B. In the configuration shown in FIG. 1, wheels A and B are locked. Brake lever 40 carries three locking pallet stones C, S1 and S2. Wheel A is locked by locking pallet stone C and wheel B by locking pallet stones S1. This is a first stable state of equilibrium in which brake lever 40 is inclined towards wheel A. Roller 43 is rotating in the direction of arrow 47. When the impulse pin 42 thereof penetrates fork 52, brake lever 40 rotates in the anticlockwise direction and passes through a median position, which releases tooth 51 from wheel A. The latter then rotates in the anticlockwise direction and imparts an impulse, via its tooth 48, to pallet stone 45 of roller 43. As roller 43 continues its travel in the direction of arrow 47, the brake lever then inclines towards wheel B, which releases tooth 50 from locking pallet stone S1, then almost simultaneously engages tooth 49 on locking pallet stone C of brake lever 40. There is a lock transfer from S1 to C, wheel B then rotating over a small angle in the clockwise direction during the transfer. In its median position, locking pallet stone S2 of brake lever 40 intersects the trajectory of the teeth of wheel A and in particular tooth 53, which then finally comes to rest on S2 when impulse pin 42, rotating in the direction of arrow 47 has exited fork 52. From now on, there is a second stable state of equilibrium in which brake lever 40 is inclined towards wheel B. This escapement system will thus be called bistable.

As ingenious as it may appear, the escapement that has just been described suffers from non-negligible drawbacks By the admission of the author of the aforecited work, this escapement is difficult to construct and the pivot holes, locking pallet stones, impulse pin and impulse pallet stones have to be precisely implanted to prevent any loss of efficiency in operation. Moreover, the escapement requires three locking pallet stones, whereas the escapement of the present invention needs only two locking pallet stones, as will be seen below. In this prior art, it was seen that there is a lock transfer from one pallet stone S1 to the other C (and in the other direction from S2 to C) allowing the wheel B concerned also to escape (and in the other direction wheel A) for a short moment, which does not occur without disturbing the operation of the system. Finally, the bistable system of the prior art appears quite different to implement from the monostable system proposed by the present invention, as the bistable system does not lead to an actual detent escapement.

SUMMARY OF THE INVENTION

In order to avoid the aforecited drawbacks, in addition to complying with the description given in the first paragraph above, the present invention is characterized in that the brake lever carries first and second locking pallet stones arranged for cooperating respectively with the first and second wheels, the brake lever having a stick the end of which cooperates with the impulse pin, the axis of the stick intersecting both the axis of the roller pivot and the axis of the brake lever pivot when the first and second wheels are locked on the first and second locking pallet stones, said brake lever also having means for re-engaging the first and second locking pallet stones respectively in the first and second escape wheels.

BRIEF DESCRIPTION OF THE DRAWINGS

The invention will now be explained in detail below via two embodiments, given by way of non-limiting example, these embodiments being illustrated by the annexed drawings, in which.

DETAILED DESCRIPTION OF THE ILLUSTRATIVE EMBODIMENTS

Figure 1:
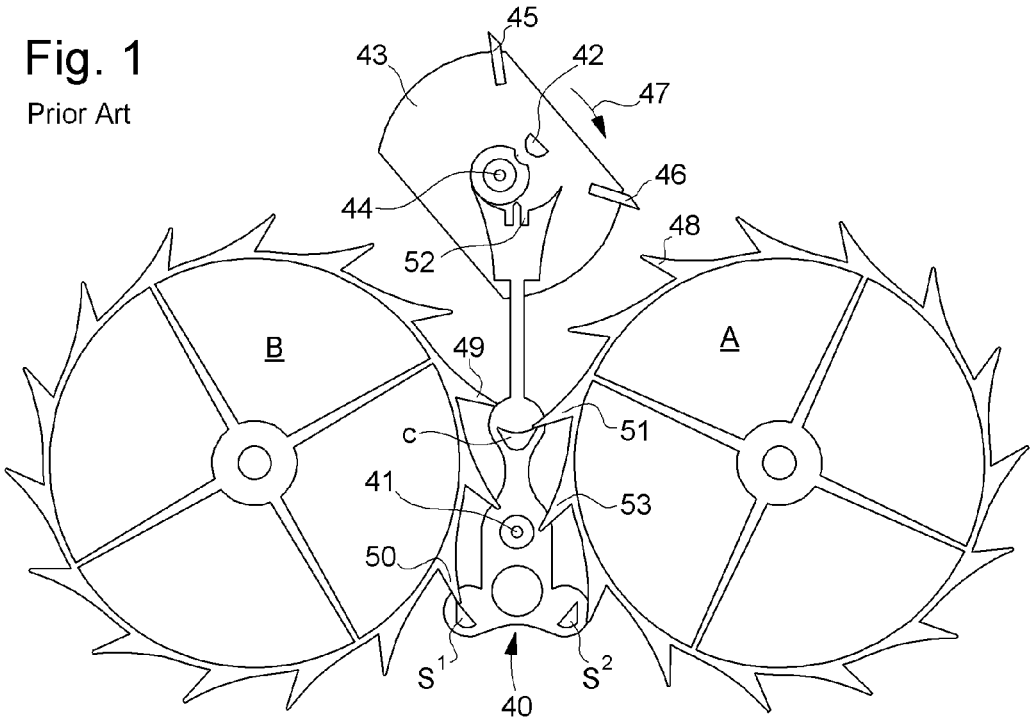
Fig. 1 Prior Art
FIG. 1 is a plan view of a dual wheel escapement according to the prior art.
Figure 2:
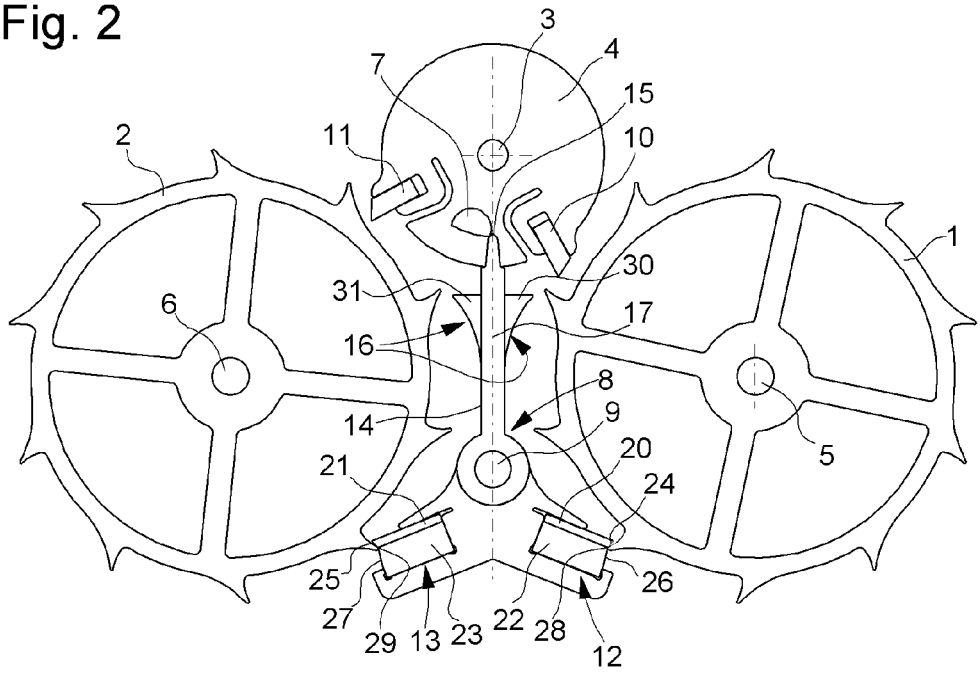
FIG. 2 is a plan view of a dual wheel escapement according to a first embodiment of the invention, which illustrates the start of unlocking of one of the wheels.

FIG. 2 is a plan view of the two-wheel escapement mechanism according to a first embodiment of the present invention. This escapement includes first and second escape wheels 1 and 2 each driven by independent gear trains and barrels. When wheel 1 is free, it rotates in the clockwise direction whereas wheel 2 rotates in the anticlockwise direction. FIG. 2 shows a roller 4 articulated on a pivot 3. Roller 4 is associated with a sprung balance that is not shown. The axis of rotation of pivot 3 is substantially equidistant from the axes of rotation 5 and 6 of the first and second wheels 1 and 2. Roller 4 carries an impulse pin 7 arranged for cooperating with a brake lever 8, the brake lever being articulated on a pivot 9. Roller 4 also carries first and second impulse pallet stones 10 and 11, the pallet stones being arranged for cooperating respectively with the first and second wheels 1 and 2. The invention differs from the prior art in that the brake lever 8 carries first and second locking pallet stones (and not three) 12 and 13 arranged for cooperating respectively with the first and second escape wheels 1 and 2. Brake lever 8 has a stick 14 the end 15 of which cooperates with impulse pin 7 of roller 4. Stick 14 has an axis 17 that intersects both the axis of pivot 3 of roller 4 and the axis of pivot 9 of the brake lever, when the first and second wheels 1 and 2 are locked on the first and second locking pallet stones 12 and 13, the brake lever then having a single stable state of equilibrium, called the monostable state, when the wheels are locked. Finally, FIG. 2 shows also that brake lever 8 has means 16 for re-engaging the first and second locking pallet stones 12 and 13, respectively, in first and second escape wheels 1 and 2.

In order to ensure proper interception of wheels 1 and 2 by locking pallet stones 12 and 13, FIG. 2 also shows that the escapement of the invention is provided with means 16 for re-engaging said locking pallet stones between the teeth of said wheels. These means have wings 30 and 31 arranged on either side of lever 14 of brake lever 8, these wings respectively cooperating with the first and second escape wheels 1 and 2. The role of these unlocking means will be explained below.

FIG. 2 also shows that locking pallet stones 12 and 13 are executed in a special way, this embodiment being motivated by operating reasons that will be explained below. In fact, the first locking pallet stones 12 has first and second plates 20 and 22 that are arranged next to each other, the first plate 20 having a first locking plane 24 and the second plate 22 having a second locking plane 26. Locking planes 24 and 26 are inclined relative to each other to form a locking line 28. The same is true of the second locking pallet stone 13, which has first and second plates 21 and 23 respectively having first and second locking planes 25 and 27 inclined relative to each other to form a locking line 29. Other manners of achieving these locking pallet stones or locking means are possible and described in detail in EP Patent No. 1,708,047-A.

One complete oscillation of roller 4 is illustrated in FIGS. 3 to 14. The various operating phases thereof will now be examined.

Figure 3:
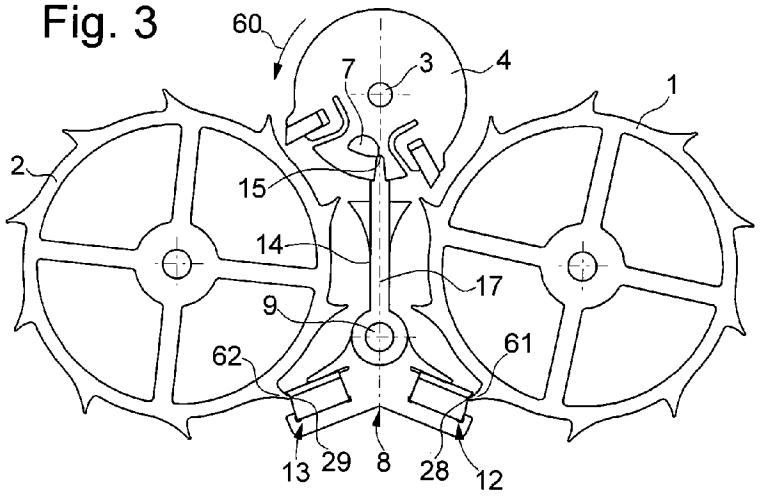

In FIG. 3, roller 4 is rotating in the direction of arrow 60. Wheels 1 and 2 are locked on locking pallet stones 12 and 13 respectively via their teeth 61 and 62 locked on locking lines 28 and 29. Impulse pin 7 enters into contact with the end 15 of stick 14 of brake lever 8. The brake lever is centred relative to the wheels, i.e. axis 17 of lever 14 intersects the axes of pivots 3 and 9 of the roller and brake lever respectively, as was already stated with reference to FIG. 2. This is the start of the unlocking of wheel 2.

Figure 4:
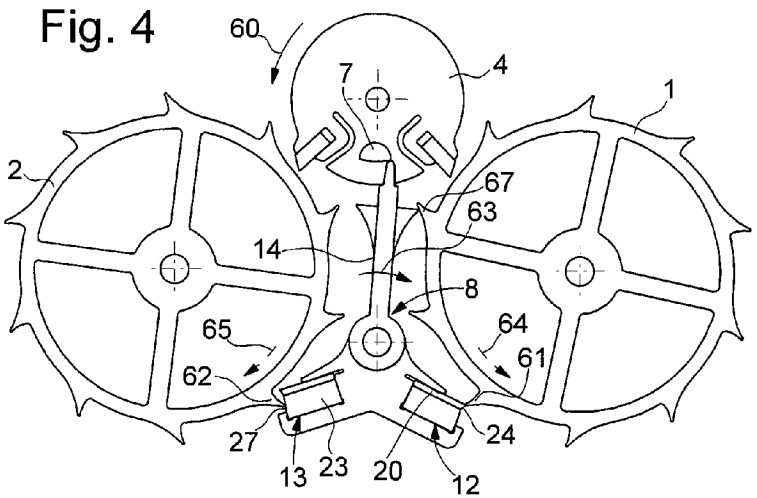
FIGS. 3 to 14 are plan views explaining the operating phases of the escapement in accordance with the first embodiment of the invention, these phases covering one complete oscillation of the roller.

In FIG. 4, roller 4 has continued its travel in the direction of arrow 60. Impulse pin 7 has driven brake lever 8 in the direction of arrow 63, forcing tooth 61 of wheel 1 to climb plane 24 of plate 20 forming locking pallet stone 12. Wheel 1 undergoes a slight backward movement caused by this climb indicated by arrow 64. During the same operation, tooth 62 of wheel 2 has climbed plane 27 of plate 23 forming locking pallet stone 13, forcing wheel 2 to move back slightly as indicated by arrow 65, to slide along tooth 20 of wheel 2 to exit the hold of the latter. This is the end of the unlocking and start of the release of wheel 1.

Figure 5:
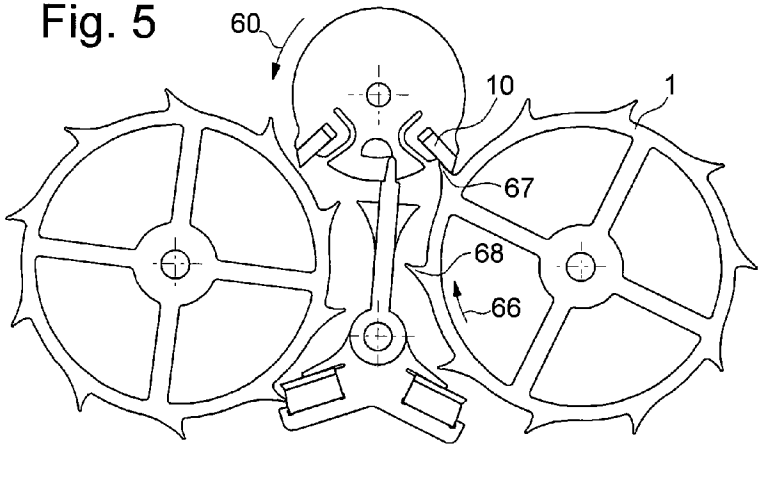

As FIG. 5 shows, the released wheel 1, driven by the timepiece gear train, rotates in the direction of arrow 66 and its tooth 67 has entered into contact with impulse pallet stone 10. This is the start of the impulse phase.

Figure 6:
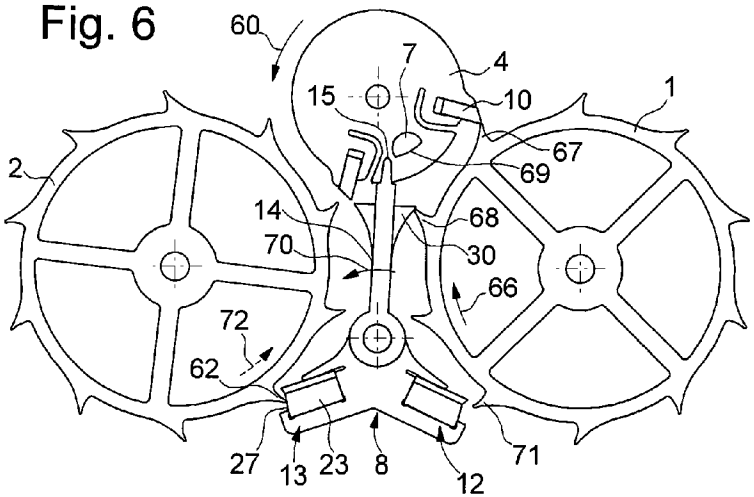

In FIG. 6, tooth 67 of wheel 1 is at the end of the impulse and has relaunched roller 4 in the same direction that it had until now (arrow 60). Tooth 67 of wheel 1 is exiting impulse pallet stone 10. Previously, the end 15 of stick 14 moved along the curved surface 69 of impulse pin 7, which held the same angle of inclination for lever 14. As soon as end 15 has left the curved surface 69, tooth 68 of wheel 1 enters into contact with wing 30 secured to stick 14. The shape of this wing is arranged for pivoting brake lever 8 in the direction of arrow 70 when tooth 68 of wheel 1 is rotating in the direction of arrow 66. The rotation of the brake lever causes locking pallet stone 12 to re-engage in wheel 1, this locking pallet stone intersecting the trajectory of tooth 71 of the same wheel. The rotation of brake lever 8 has slightly lowered tooth 62 of wheel 2 along plane 27 of plate 23 forming locking pallet stone 13. This descent causes a slight rotation of wheel 2 in the direction of arrow 72.

Figure 7:
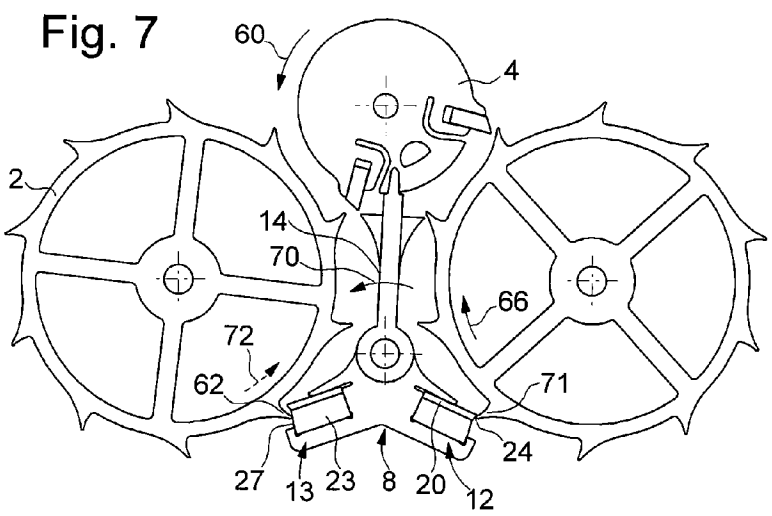

FIG. 7 shows the locking of wheel 1 on locking pallet stone 12. Roller 4 has continued its travel in the direction of arrow 60 to occupy the place shown in the drawing. Tooth 71 of wheel 1, driven along arrow 66, has fallen onto plane 24 of plate 20 forming locking pallet stone 12. Wheel 1 is locked. From this moment, the rotational force of wheel 1 causes tooth 71 to descend along plane 24. Likewise, the rotational force of wheel 2 causes tooth 62 to descend along plane 27 of plate 23 forming locking pallet stone 13. This is what is called draw in horological terminology. Brake lever 8 thus continues to rotate in the direction of arrow 70.

Figure 8:
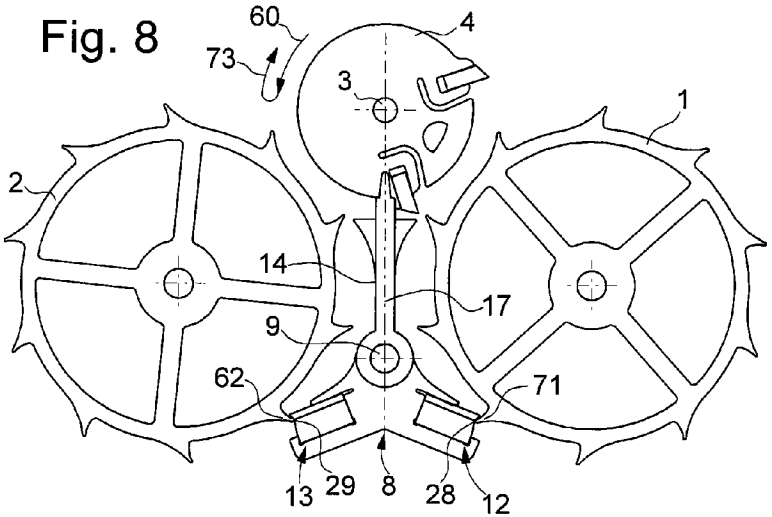

The rotation of brake lever 8 ends at the moment that teeth 62 and 71 abut respectively on locking lines 28 and 29 of wheels 1 and 2 by the draw exerted by said wheels. This is what is seen in FIG. 8 which shows the total lock of wheels 1 and 2 on locking pallet stones 12 and 13. At this moment, brake lever 8 occupies a centred position relative to the two wheels 1 and 2. This is the monostable state referred to above in which axis 17 of lever 11 intersects both the axis of pivot 3 of roller 4 and the axis of pivot 9 of brake lever 8. From this moment, roller 4 describes its supplementary arc in the direction of the same arrow 60 to retrace its steps and rotate in the direction of arrow 73.

Figure 9:
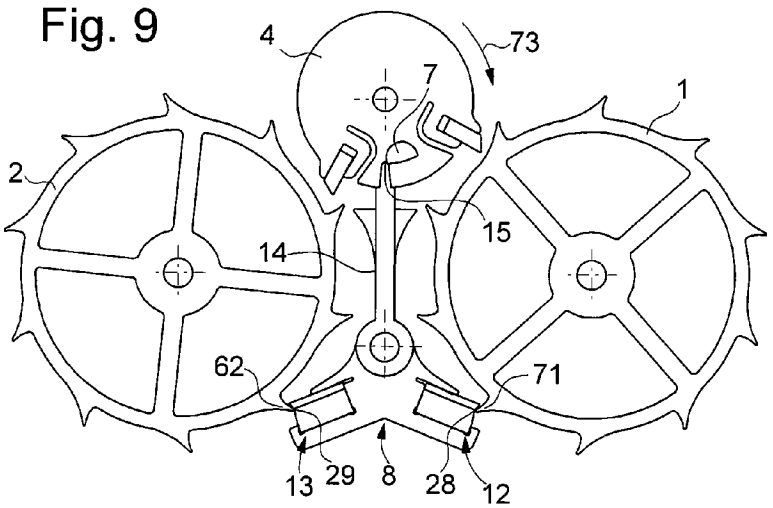

All of the foregoing will then be repeated, but in the opposite direction. As can be seen in FIG. 9, roller 4 is rotating in the direction of arrow 73. Wheels 1 and 2 are locked on locking pallet stones 12 and 13 respectively, by their teeth 71 and 62 locked on their locking lines 28 and 29. Impulse pin 7 enters into contact with the end 15 of lever 14 of brake lever 8. This is the start of the unlocking of wheel 2.

Figure 10:
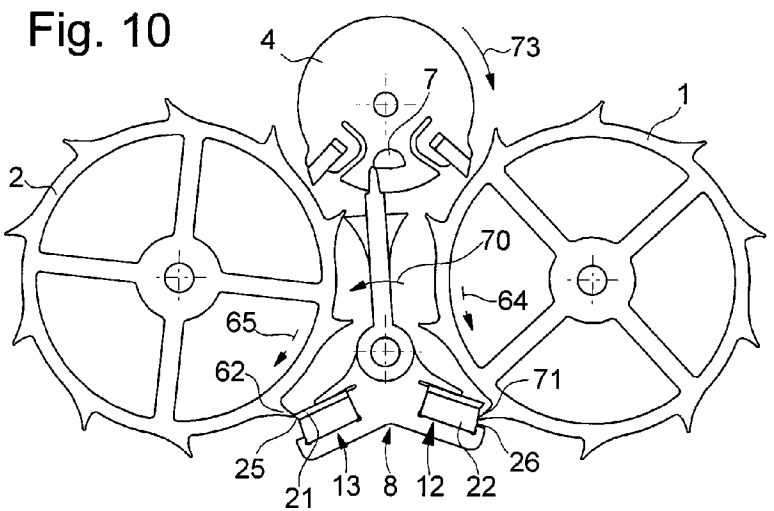

In FIG. 10, roller 4 has continued its travel in the direction of arrow 73. Impulse pin 7 has driven brake lever 8 in the direction of arrow 70, forcing tooth 62 of wheel 2 to climb plane 25 of plate 21 forming locking face 13. Wheel 2 then undergoes a slight backward movement caused by this climb indicated by arrow 65. During the same operation, tooth 71 of wheel 1 has climbed plane 26 of plate 22 forming locking pallet stone 12, forcing wheel 1 to move back slightly as indicated by arrow 64, to slide along tooth 20 of wheel 2 to exit the hold of the latter. This is the end of the unlocking and start of the unlocking of wheel 2.

Figure 11:
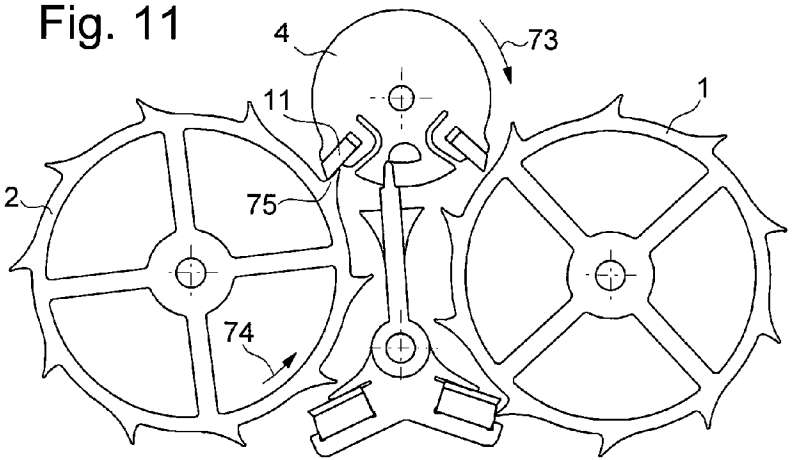

As FIG. 11 shows, the released wheel 2, driven by the timepiece gear train, has rotated in the direction of arrow 74 and its tooth 75 has entered into contact with impulse pallet stone 10. This is the start of the impulse phase.

Figure 12:
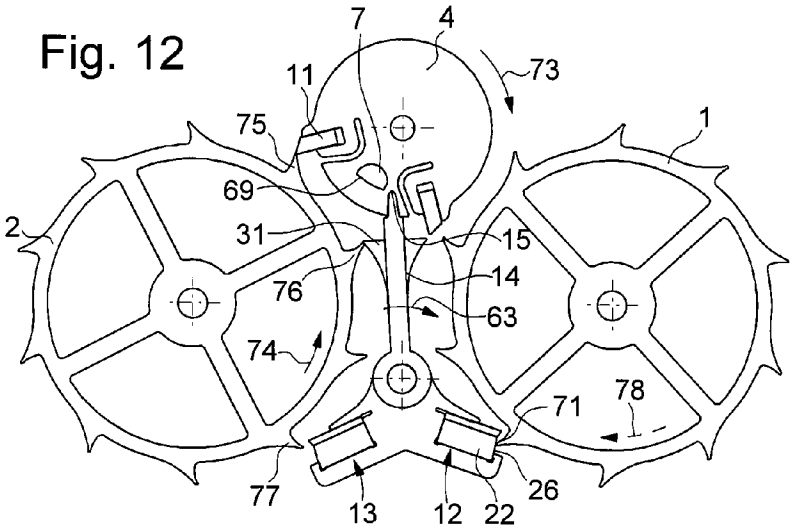

In FIG. 12, tooth 75 of wheel 2 is at the end of the impulse and has relaunched roller 4 in the same direction that it had until now (arrow 73). Tooth 75 of wheel 2 is exiting impulse pallet stone 11. Previously, the end 15 of stick 14 moved along the curved surface 69 of impulse pin 7, which held the same angle of inclination for lever 14. As soon as end 15 has left the curved surface 69, tooth 76 of wheel 2 enters into contact with wing 31 secured to stick 14. The shape of this wing is arranged for pivoting brake lever 8 in the direction of arrow 63 when tooth 76 of wheel 2 is rotating in the direction of arrow 74. The rotation of the brake lever causes locking pallet stone 13 to re-engage in wheel 2, this locking pallet stone intersecting the trajectory of tooth 77 of the same wheel. The rotation of brake lever 8 has slightly lowered tooth 71 of wheel 1 along plane 26 of plate 22 forming locking pallet stone 12. This descent causes a slight rotation of wheel 1 in the direction of arrow 78.

Figure 13:
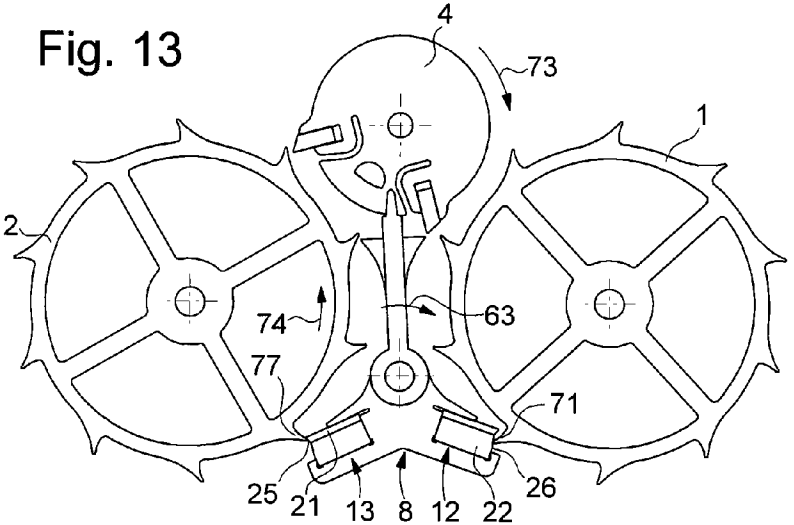

FIG. 13 shows the locking of wheel 2 on pallet stone 13. Roller 4 has continued its travel in the direction of arrow 73 to occupy the place shown in the drawing. Tooth 77 of wheel 2 driven along arrow 74 has fallen onto plane 25 of plate 21 forming pallet stone 13. Wheel 2 is locked. From this moment the rotational force of wheel 2 causes tooth 77 to descend along plane 25. Likewise the rotational force of wheel 1 causes tooth 71 to descend along plane 26 of plate 22 forming pallet stone 12. This is the draw mentioned above. Brake lever 8 continues to rotate in the direction of arrow 63.

Figure 14:
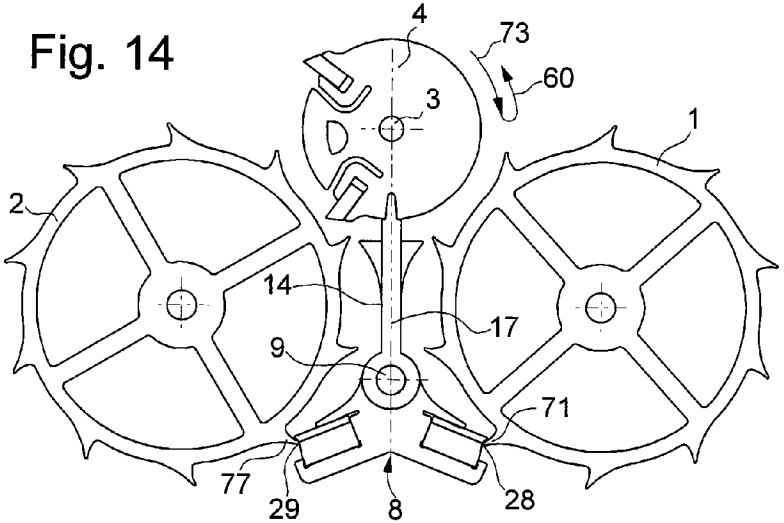

The rotation of brake lever 8 ends at the moment that teeth 71 and 77 abut respectively on locking lines 28 and 29 of wheels 1 and 2 by the draw exerted by said wheels. This is what is seen in FIG. 14, which shows the total lock of wheels 1 and 2 on locking pallet stones 12 and 13. At this moment, brake lever 8 again occupies a centred position relative to the two wheels 1 and 2. This is again the monostable state referred to above in which axis 17 of stick 14 intersects both the axis of pivot 3 of roller 4 and the axis of pivot 9 of brake lever 8. From this moment, roller 4 describes its supplementary arc (arrow 73) to retrace its steps and rotate in the direction of arrow 60. One complete oscillation of the roller has thus ended and we are again in the situation shown in FIG. 3.

The explanations that have been given until now relate to a first embodiment of the invention. In this embodiment, means 16 for re-engaging the locking pallet stones in the toothing of the corresponding wheels are wings 30 and 31 arranged on either side of lever 14 of brake lever 8.

Figure 15:
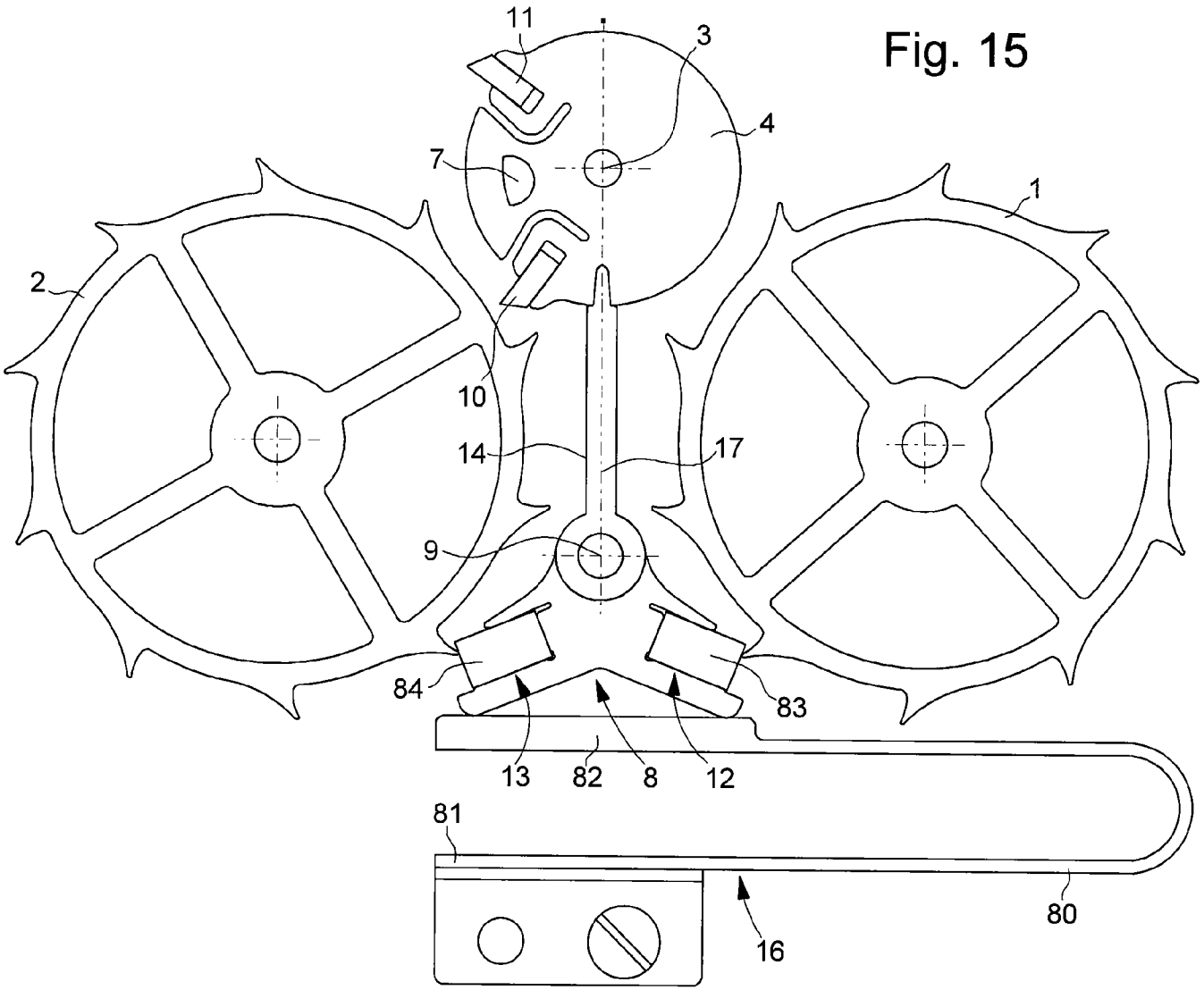
FIG. 15 is a plan view of the dual wheel escapement according to a second embodiment of the invention.

FIG. 15 shows a second embodiment of the invention. Here, re-engaging means 16 are no longer the wings described above, but a spring acting on brake lever 8. More specifically, the spring in question is a strip spring 80, one end 81 of which is secured to the frame of the timepiece and the other end 82 of which is arranged for exerting an equal force on the first and second locking pallet stones 12 and 13 when axis 17 of lever 14 of brake lever 8 intersects both the axis of pivot 3 of roller 4 and the axis of pivot 9 of brake lever 8, in other words, when the brake lever occupies a centred position relative to the two escape wheels.

In the case that has just been explained, it will be clear that if the force exerted by spring 80 on locking pallet stones 12 and 13 is greater than the draw force exerted by each of escape wheels 1 and 2 on the same locking pallet stones, it is no longer necessary to make said locking pallet stones in two plates arranged side by side, as was the case of the first embodiment described above. In fact, the tip of the tooth will naturally stop on a locking line located inside the single locking pallet stone presented by the locking face as is apparent in FIG. 15. Here, locking pallet stones 12 and 13 are single block locking pallet stones 83 and 84.

Strip spring 80 may be replaced by other embodiments. This could be, for example, a spiral shaped spring one end of which is secured to frame and the other end of which is secured to pivot 9 of brake lever 8. This solution, which is not illustrated here, could be replaced by two strip springs arranged either side of stick 14 or by a single strip secured on the brake lever, at the first end thereof, and retained at the second end thereof between two pins secured to the timepiece frame.

It should be noted finally that the independent dual wheel escapement allows a dual display, with each display showing different time zone indications.

What is claimed is:

1. A detent escapement for a timepiece including first and second escape wheels each driven by independent gear trains and barrels and a balance on the pivot of which is there is secured a roller, the axis of rotation of said pivot being located substantially equidistant from the axes of rotation of the first and second wheels, said roller carrying an impulse pin arranged for cooperating with a brake lever articulated on a pivot, and carrying first and second impulse pallet stones arranged for cooperating respectively with the first and second wheels, wherein the brake lever carries first and second locking pallet stones arranged for cooperating respectively with the first and second wheels, said brake lever having a stick the end of which cooperates with the impulse pin of the roller, the stick having an axis intersecting both the axis of the pivot of the roller and the axis of the pivot of the brake lever when the first and second wheels are locked on the first and second locking pallet stones, said brake lever also having means for re-engaging the first and second locking pallet stones respectively in the first and second escape wheels.

2. The detent escapement according to claim 1, wherein the engagement means are wings arranged on either side of the stick of the brake lever for cooperating respectively with the first and second escape wheels.

3. The detent escapement according to claim 2, wherein the first and second locking pallet stones each have first and second plates arranged next to each other and respectively having first and second locking planes inclined relative to each other to form a locking line.

4. The detent escapement according to claim 1, wherein the re-engagement means consist of a spring acting on the brake lever.

5. The detent escapement according to claim 4, wherein said spring is a strip spring, one end of which is secured to the frame of the timepiece and the other end of which is arranged for exerting an equal force on the first and second locking pallet stones when the axis of the stick of the brake lever intersects both the axis of the pivot of the roller and the axis of the pivot of the brake lever.

6. The detent escapement according to claim 4, wherein the first and second locking pallet stones each have a single block plate.

7. The detent escapement according to claim 5, wherein the first and second locking pallet stones each have a single block plate.

* * * * *